United States Patent [19]

Nagel et al.

[11] Patent Number: 4,786,269

[45] Date of Patent: Nov. 22, 1988

[54] FOUR-WHEEL DRIVE TOY VEHICLE

[75] Inventors: Dietmar Nagel, Chester, N.J.; Melvin R. Kennedy, Hampton Bays, N.Y.; Avi Arad, Westport, Conn.

[73] Assignee: Lewco Toys, Ltd., New York, N.Y.

[21] Appl. No.: 445,507

[22] Filed: Nov. 30, 1982

[51] Int. Cl.[4] ..... A63H 29/00

[52] U.S. Cl. ..... 446/464

[58] Field of Search ..... 46/201, 202, 206, 207, 46/209; 446/464

[56] References Cited

U.S. PATENT DOCUMENTS

| | | | |
|---|---|---|---|
| 2,350,760 | 6/1944 | Horn | 46/206 |
| 3,564,765 | 11/1968 | Stormon et al. | 46/206 |
| 3,748,780 | 7/1973 | Glass et al. | 46/206 X |
| 3,798,831 | 3/1974 | Higashi | 46/206 |
| 3,932,956 | 1/1976 | Young | 46/202 |
| 3,981,098 | 9/1976 | Darda | 46/206 |
| 4,077,156 | 3/1978 | Asano | 46/206 |
| 4,135,328 | 1/1979 | Yamasaki | 46/209 X |
| 4,283,879 | 8/1981 | Tsui | 46/206 X |
| 4,332,104 | 6/1982 | Ribas et al. | 46/206 |

FOREIGN PATENT DOCUMENTS

| | | | |
|---|---|---|---|
| 2106402 | 4/1983 | United Kingdom | 46/202 |

*Primary Examiner*—Robert A. Hafer

*Attorney, Agent, or Firm*—Michael Ebert

[57] ABSTRACT

A four-wheel drive toy vehicle having a spring-wound motor capable of travelling over hills and other obstacles. The vehicle is provided with front and rear traction wheel sets whose axles extend across the chassis which support the body. Each axle has a pinion thereon which engages the front section of a two-section coupling gear that meshes with the input gear of a flat spiral spring motor whose output gear engages the rear section of the coupling gear. The input gear is coupled to the input of the spring through a one-way clutch whereby when the vehicle is grasped by the player and pulled back along the ground, the input gear is caused to turn by both pinions to thereby wind up the spring; and when the vehicle is released, the output gear which is turned by the unwinding spring then acts to drive both pinions to advance the vehicle in the foward direction. One of the pinions is coupled by a gear train to a governor which acts to regulate the speed of wheel rotation.

4 Claims, 2 Drawing Sheets

Fig. 1.
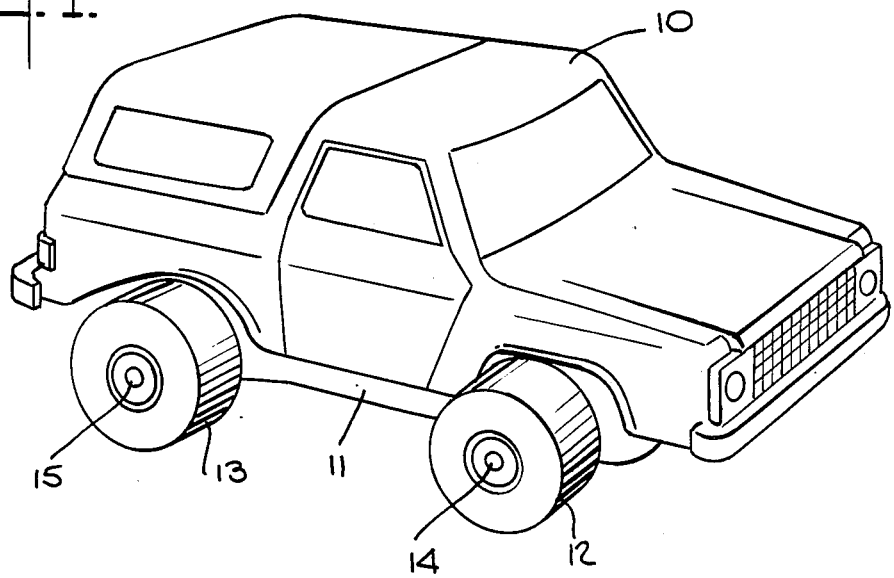
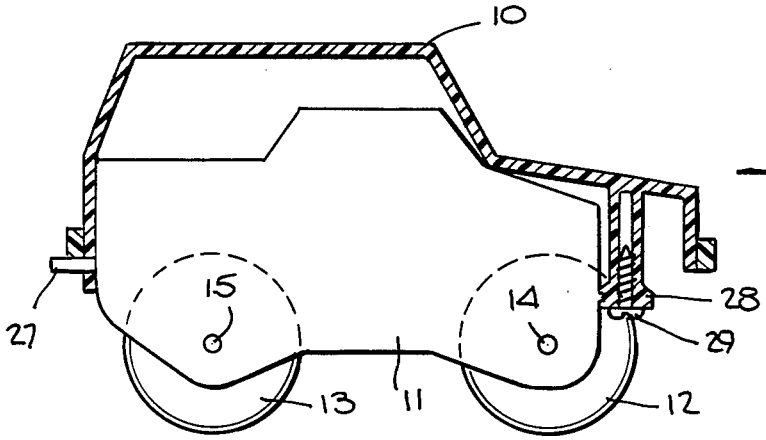
Fig. 2.
Fig. 3.
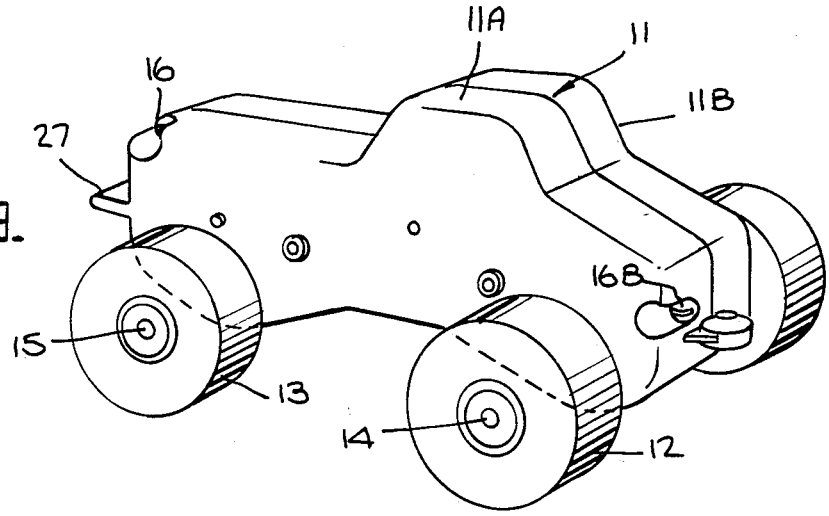

FOUR-WHEEL DRIVE TOY VEHICLE

BACKGROUND OF INVENTION

This invention relates generally to toy vehicles powered by wind-up spring motors, and more particularly to a toy vehicle of this type having a high-torque, four-wheel drive, the wheels being driven at a governed speed whereby the vehicle is capable of riding over small hills and other obstacles.

The use of wind-up spring motors for propelling miniature vehicles is commonplace in the toy field. Traditionally, these motors are wound by means of a key which engages the spring shaft. But because small children have difficulty operating a key, the trend in recent years has been toward so-called pull-back toys in which a coupling is provided between the rear wheels and the spring motor. In this arrangement, when the toy is grasped by the player and pulled back along the ground, this reverse movement acts to wind the spring. And when the vehicle is then released, the unwinding spring acts to propel the vehicle in the forward direction.

Among the patents disclosing pull-back vehicles are those to Higashi, No. 3,798,831 (Tonka Corp.) and to Darda, 3,812,933. Tonka and Darda miniature cars are well known in the toy field.

One difficulty experienced with pull-back toy vehicles in which the rear wheels act to wind up the spring motor, is that if the player holding the car against the ground applies most of his pressure against the front wheels, the rear wheels will not frictionally engage the ground and the spring will not then be wound, Also, with a pull-back toy, when the spring motor is fully charged and the vehicle is released, the vehicle immediately leaps forward and rushes at relatively high speed in the direction chosen by the player. As a consequence, the motor, whose release of energy is uncontrolled, quickly winds down; and though the motor is exhausted, the car continues to move a fairly short distance by reason of its inertia.

A pull-back vehicle of the conventional type is an effective toy when one plays on a level, unobstructed surface. But these spring-wound vehicles rapidly dissipate their power and are therefore incapable of climbing up miniature hills, inclined surfaces or other obstacles placed in their path. Thus while it is fun for a player to see his car race over a level surface, he may be disappointed when the car fails to travel up an inclined path or overcome other obstacles.

In the real world of cars having internal-combustion engines, when the need arises for a car to negotiate rough terrain or steep hills, use is made of a vehicle having traction wheels and a four wheel drive, the car operating in a gear ratio affording high torque. But an equivalent arrangement has not heretofore been found in spring-powered toy vehicles, for their existing structures do not lend themselves to such an arrangement.

Since what affords the greatest play satisfaction to children are miniature vehicles that are capable of performing in the manner of a real vehicle, the inability of toy vehicles to climb hills and to ride over other obstacles has created a need for toy vehicles having this impressive capability.

SUMMARY OF INVENTION

In view of the foregoing, the main object of this invention is to provide a miniature spring-motor toy vehicle having a four-wheel drive capable of performing in a manner comparable to a full-scale vehicle of this type.

More particularly, an object of this invention is to provide a four-wheel drive, spring-powered vehicle in which both the front and rear wheel sets act to wind up the motor when the vehicle is pulled back on the ground by the player, so that as long as either set engages the ground, a wind-up action will take place.

Also an object of the invention is to provide a hight-orque, four-wheel drive toy vehicle whose speed is governed so that the unwinding action of the motor is steady and prolonged to prevent rapid dissipation of the motor power.

Yet another object of the invention is to provide a vehicle of the above type which lends itself to low-cost mass production.

Briefly stated, these objects are attained in a four-wheel drive toy vehicle having a spring-wound motor capable of travelling over hills and other obstacles. The vehicle is provided with front and rear traction wheel sets whose axles extend across the chassis which supports the body. Each axle has a pinion thereon which engages the front section of a two-section coupling gear that meshes with the input gear of a flat spiral spring motor whose output gear engages the rear section of the coupling gear. The input gear is coupled to the input of the spring through a one-way clutch whereby when the vehicle is grasped by the player and pulled back along the ground, the input-gear is caused to turn by both pinions to thereby wind up the spring; and when the vehicle is released, the output gear which is turned by the unwinding spring then acts to drive both pinions to advance the vehicle in the forward direction. One of the pinions is coupled by a gear train to a governor which acts to regulate the speed of wheel rotation.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a toy vehicle in accordance with the invention;

FIG. 2 is a longitudinal section taken through the vehicle;

FIG. 3 is a perspective of the chassis separated from the body of the vehicle;

Figure 4:
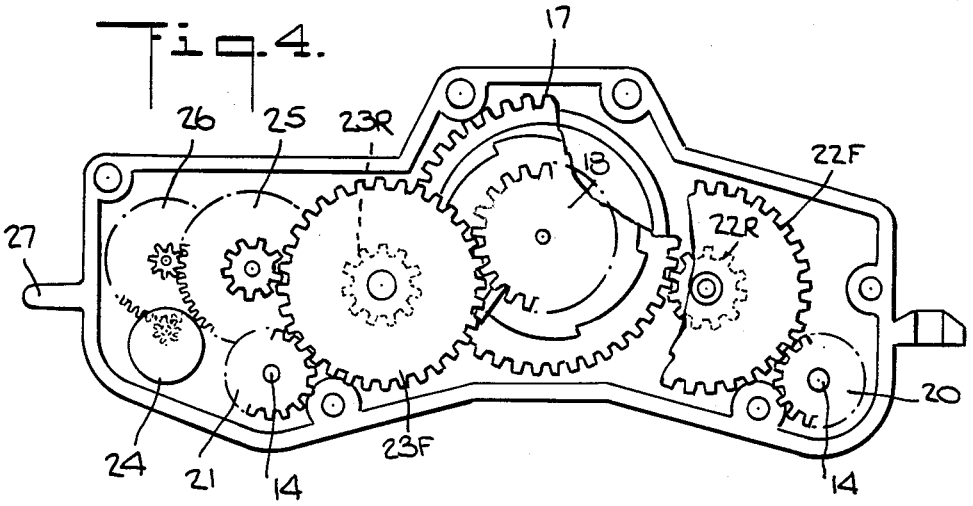
FIG. 4 is a side view showing the mechanism housed within the chassis.
Figure 5:
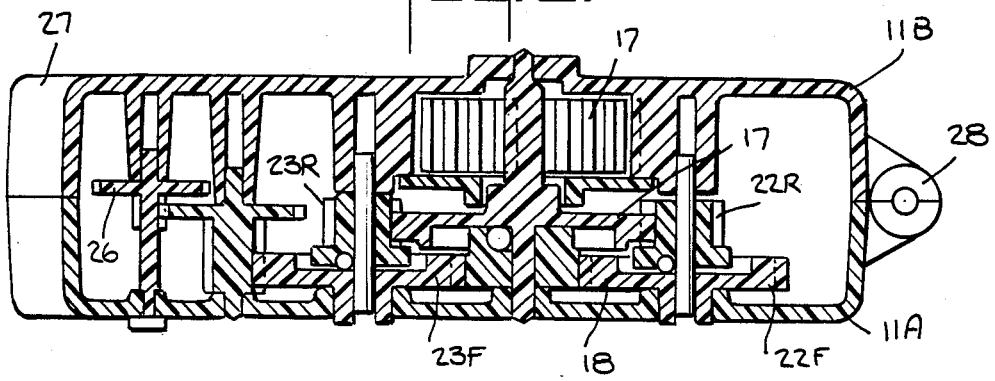
FIG. 5 is a top view of the mechanism.
Figure 6:
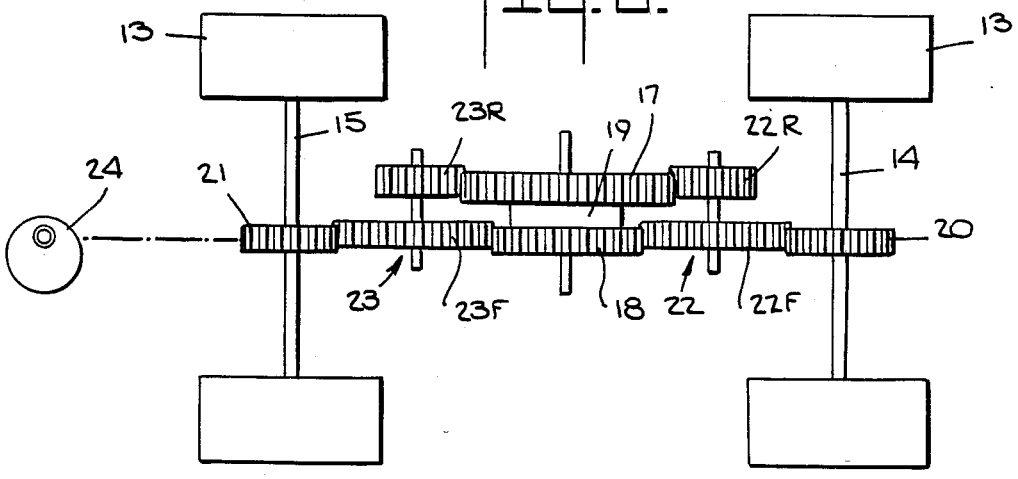

FIG. 6 schematically illustrates the functional relationship of the gears included in the mechanism.

DESCRIPTION OF INVENTION

Structure:

Referring now to FIGS. 1 and 2, there is shown a toy vehicle in accordance with the invention, the vehicle having a body 10 which is a small-scale version of a conventional auto body in any desired style. The body rests on a chassis 11 which is concealed thereby. Supported by the chassis is a set of front traction wheels 12 and a like set of rear traction wheels 13. The front wheel set rotates on an axle 14 extending across the chassis and the rear wheel set rotates on a parallel axle 15.

Chassis 11 is composed of a pair of molded plastic half pieces 11A and 11B which are held together by screws 16 to envelop the internal mechanism of the vehicle. Mounted within the chassis at a position intermediate, front and rear axles 14 and 15 is a flat spiral spring motor in which the spring coil is coupled to an output gear 17. The spring is wound by means of an input gear 18 through a one-way clutch 19, the input and output gears turning on a common axis parallel to the axles. The arrangement is such that when input gear 18 is turned in the counter clockwise direction; this acts to wind up the spring, no winding taking place when the input gear turns in the opposite direction. Since spring motors of this type are well known and, per se, form no part of this invention, the details thereof will not be further detailed herein.

Secured to front axle 14 is a drive pinion 20, and similarly secured to rear axle 15 is a like pinion 21. Pinion 20 is operatively linked to the spring motor by a two-section coupling gear 22 whose front section 22F intermeshes with both the pinion and input gear 18, and whose rear section 22R engages output gear 17. Pinion 21 for the rear axle is similarly linked to the spring motor by a two-section coupling gear 23 whose front section 23F intermeshes both with this pinion and input gear 18, and whose rear section 22R engages output gear 17.

Front section 23F of coupling gear 23 for the rear wheel pinion is also coupled by way of a gear train to a speed governor 24, the train being constituted by gears 25 and 26. The governor is an eccentric body which is caused to rotate as the coupling gear turns and serves to maintain the rotary speed of the motor at a substantially constant rate.

The rear end of chassis 11 is provided with a projecting tongue 27 which is received within a socket in the rear of the body 10, the front end of the chassis having a projecting ring 28 in which a screw 29 is inserted to lock the chassis to the body.

Operation:

When the vehicle is pulled back on the ground by a player, the front and rear wheels sets then turn in the counterclockwise direction. Since the front and rear axle pinions 20 and 21 are operatively coupled to opposite sides of the motor input gear 18, this causes input gear 18 to turn in counterclockwise direction and to thereby wind up the motor.

It is important to note that input gear 18 will be caused to turn in the counterclockwise direction when either of the wheel sets is turned in the counterclockwise direction or when both set are turned concurrently in this direction. Hence if a player who grasps the toy vehicle and presses it against the ground while pulling it back, applies pressure in such a way that only one set rather than both sets are in effective frictional engagement with the ground, the motor will nevertheless be wound up. The player need not, therefore, exercise particular care in this wind-up operation. In practice, the motor may include a click which is actuated to give off a sound when the spring is fully wound.

When the vehicle is thereafter released, the output gear 17 of the motor proceeds to turn in the clockwise direction under the tension of the spring as it unwinds. This action causes the front and rear axle pinions which are coupled to opposite sides of the output gear to turn clockwise, thereby driving the vehicle forward. And while the clockwise turning of the pinions also cause the input gear to rotate clockwise, because of the one-way clutch, this has no effect on the spring.

The gear ratios are such as to provide a relatively slow steady speed with a high degree of torque so that the vehicle, in the manner of a standard, real life, four-wheel drive vehicle is capable of travelling over rigorous terrain and of negotiating hills and other obstacles.

While there has been shown and described a preferred embodiment of a four-wheel drive toy vehicle in accordance with the invention, it will be appreciated that many changes and modifications may be made therein without, however, departing from the essential spirit thereof.

I claim:

1. A four-wheel drive toy vehicle capable of negotiating hills and other obstacles, said vehicle comprising:

A. a chassis to support a vehicle body, said chassis having front and rear axles extending thereacross whose ends have wheels attached thereto, each axis having a drive pinion thereon;

B. a spiral spring motor mounted within the chassis at a position intermediate the axles, said motor having an input gear coupled to the spring through a one-way clutch whereby winding takes place only when the input gear is turned counterclockwise, and an output gear which turns clockwise when the spring winds, said input and output gears lying on a common axis parallel to the axles;

C. first and second dual-section coupling gears on opposite sides of the motor for operatively linking the front and rear axle pinions to the input and output gears, the first dual-section coupling gear having a shaft parallel to said front axle and the second dual-section coupling gear having a shaft parallel to said rear axle, each dual section coupling gear having a front section intercoupling the associated pinion with the input gear and a rear section engaging the output gear whereby when the vehicle is pulled back on the ground by a player to travel in the reverse direction, the pinions then turn counterclockwise to cause the input gear to turn counterclockwise to wind the motor; and when the vehicle is released, the output gear turns clockwise to cause the pinions to turn clockwise to drive the vehicle in the forward direction; and D. a governor operatively coupled by a gear train to one of said pinions to regulate the speed of rotation of the output gear and prevent rapid unwinding of the spring.

2. A vehicle as set forth in claim 1, wherein said governor is constituted by an eccentric rotating mass.

3. A vehicle as set forth in claim 1, wherein said chassis is formed by a pair of half-pieces which when joined together envelop the mechanism therein.

4. A vehicle as set forth in claim 1, wherein said wheels are traction wheels.

* * * * *